US007047867B2

(12) United States Patent
Kalkstein et al.

(10) Patent No.: US 7,047,867 B2
(45) Date of Patent: May 23, 2006

(54) OSCILLATING DEVICE FOR ADJUSTING THE DISPLACEMENT OF A FLUID PUMP

(75) Inventors: James Kalkstein, Rochester Hills, MI (US); Marko Biedermann, Waterford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 71 days.

(21) Appl. No.: 10/899,943

(22) Filed: Jul. 27, 2004

(65) Prior Publication Data

US 2006/0021499 A1 Feb. 2, 2006

(51) Int. Cl.
*F04B 17/05* (2006.01)

(52) U.S. Cl. ..... 92/12.2; 92/13.1; 417/271; 417/364

(58) Field of Classification Search ..... 92/12.2, 92/13.1, 57, 66, 76, 140; 91/183; 417/222.1, 417/271, 364; 74/60
See application file for complete search history.

(56) References Cited

U.S. PATENT DOCUMENTS 2,957,421 A 10/1960 Mock
3,263,513 A * 8/1966 Girodin ..... 417/271
3,486,454 A * 12/1969 Tuzson ..... 92/12.2
3,808,811 A 5/1974 Lepelletier
4,838,216 A * 6/1989 Yang ..... 417/364
6,206,650 B1 * 3/2001 Thurner ..... 92/12.2
6,312,231 B1 * 11/2001 Kuhne et al. ..... 92/12.2

FOREIGN PATENT DOCUMENTS

WO WO91/09228 6/1991

* cited by examiner

*Primary Examiner*—Edward K. Look
*Assistant Examiner*—Michael Leslie
(74) *Attorney, Agent, or Firm*—David B. Kelley; MacMillan, Sobanski & Todd

(57) ABSTRACT

A device for adjusting the displacement of a fluid pump includes a swashplate supported for pivotal movement about a first axis, and an engine having first and second cylinders. A first piston is located in the first cylinder and secured to the swashplate at a first side of the first axis. A second piston is located in the second cylinder and secured to the swashplate at a second side of the first axis opposite the first side. A plate is secured to the swashplate for pivotal movement about the first axis and is supported for rotary oscillation relative to the swashplate about a second axis. A pump includes a third cylinder and a first plunger located in the third cylinder, secured to the plate for pivotal movement about the first axis and rotary oscillation about the second axis. The plunger displaces fluid from the third cylinder as the plunger reciprocates.

21 Claims, 3 Drawing Sheets

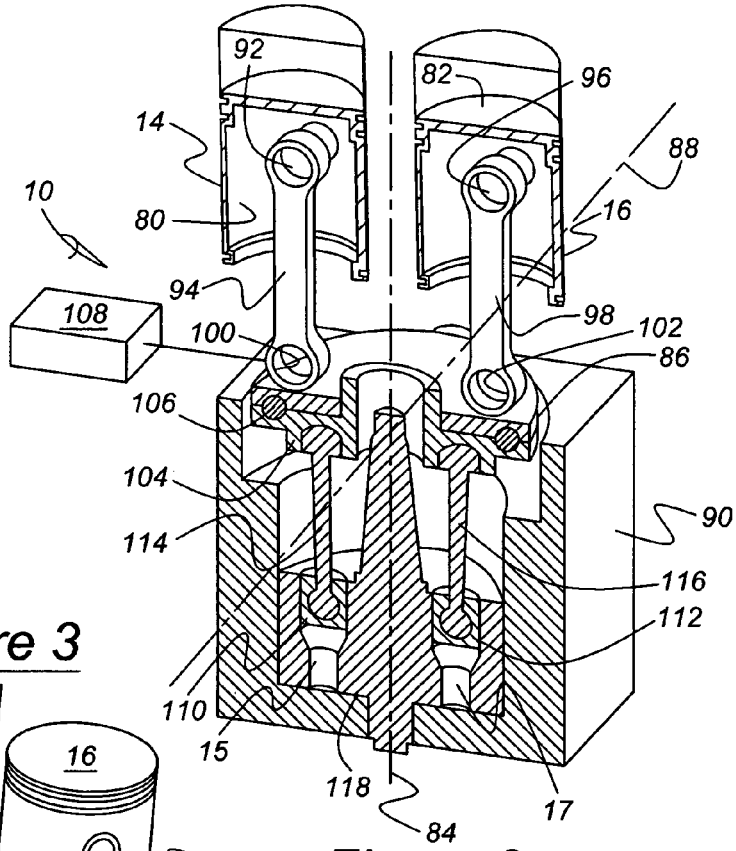
Figure 2
Figure 3
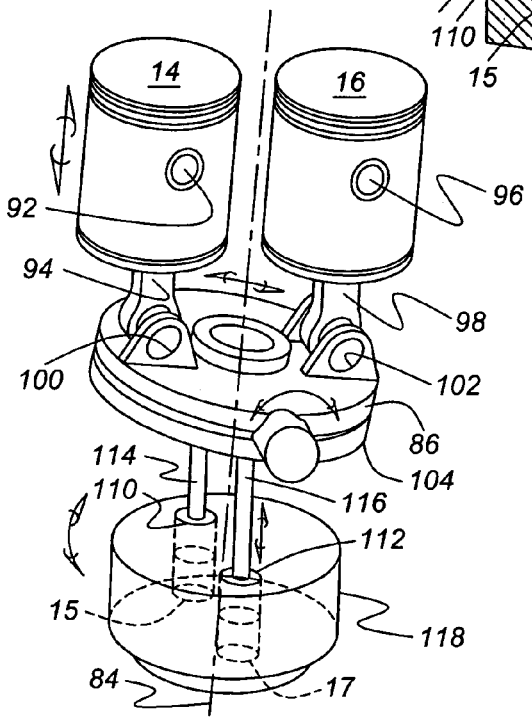

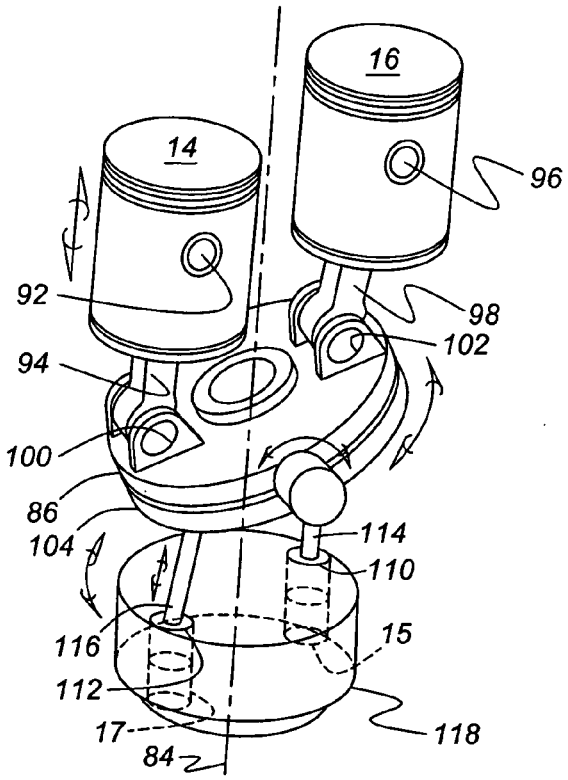
Figure 4
Figure 5
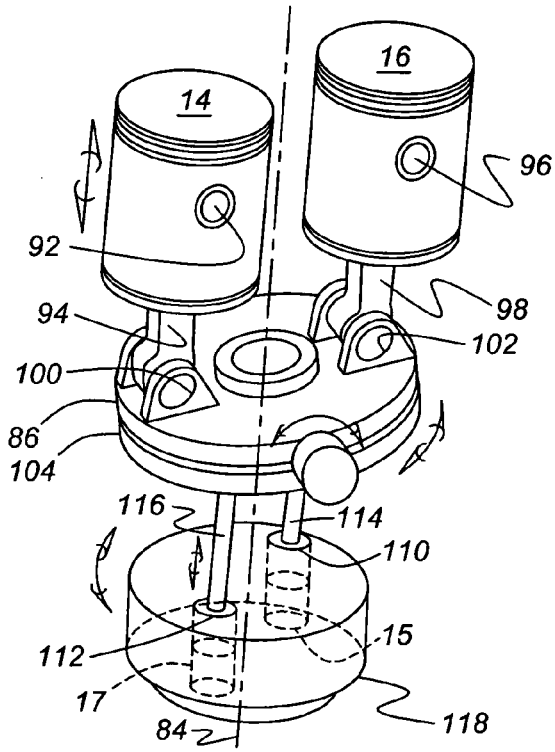

OSCILLATING DEVICE FOR ADJUSTING THE DISPLACEMENT OF A FLUID PUMP

BACKGROUND OF THE INVENTION

This invention relates to adjusting the displacement of a fluid pump. In particular, the invention relates to adjusting the starting load on an engine-pump that supplies pressurized hydraulic or pneumatic fluid for driving the wheels of a vehicle having a hybrid powertrain.

A hybrid powertrain motor vehicle may include various sources of power including an internal combustion engine, which drives a fluid pump, and other on-board sources of fluid pressure, such as an accumulator. Pressurized fluid is supplied to hydraulic or pneumatic motors, which drive the vehicle wheels. Generally, such a hybrid powertrain includes a power accumulator containing fluid at relatively high pressure and a regeneration accumulator, in which kinetic energy of the vehicle, recovered from a brake regeneration system, is stored in the form of pressurized fluid. The accumulators and pump supply fluid to the motors at the wheels through a high pressure rail. Fluid exiting the fluid motors is returned to a reservoir, from which fluid is drawn to the pump inlet.

The stroke of the fixed displacement pump driven by the engine is a constant. The magnitude of pressure in the supply rail varies according to the degree to which the driver demands output power, the frequency and magnitude of brake energy recovery events, the energy storage capacity of the accumulators, and other unpredictable factors including road conditions. When the engine is turned off, the magnitude of supply rail pressure is influenced by these conditions. Upon restarting the engine, the starting load on the engine and pump is affected by the magnitude of supply rail pressure.

Because there is little control over supply rail pressure and no control over the stroke of the fixed displacement pump, the engine may be required to start repeatedly against a large load, the pressure in the supply rail. Certain engines, such as a free piston engine or a conventional internal combustion engine operating with homogeneous combustion compression ignition, perform best when the amount of fuel supplied to the engine, the engine compression ratio, and the air-fuel ratio are controlled for each engine cycle within a close tolerance, even at engine startup. If these parameters are not maintained within narrow tolerances for each engine cycle, such engines are susceptible to starting difficulties and stalling.

To avoid these difficulties, it is preferred that such engines be started with idle fuel quantities so that the engine can respond to a demand for maximum power output after a large number of engine cycles have occurred after starting, rather than immediately upon startup. To accomplish this desired reduction in starting load, even when supply rail pressure is high, a technique is required to reduce the effective load on the engine for a period during and immediately after engine startup.

SUMMARY OF THE INVENTION

The present invention changes the effective displacement or stroke of a piston pump. An actuator controlled by an electronic control system varies the angular position of an angularly oscillating plate, which is driveably connected to a pivoting swashplate. The engine pistons pivot the swashplate as the pistons reciprocate. The displacement of the pump varies in accordance with the angular displacement of the rotary plate, the disposition of the swashplate, and the distance between a swashplate pivot axis and the pump cylinders.

A device for adjusting the displacement of a fluid pump according to this invention includes a swashplate supported for pivotal movement about a first axis, and an engine having first and second cylinders. A first piston, located in the first cylinder, is secured to the swashplate at a first side of the first axis. A second piston, located in the second cylinder, is secured to the swashplate at a second side of the first axis opposite the first side. A plate is secured to the swashplate for pivotal movement about the first axis and is supported for rotary oscillation relative to the swashplate about a second axis. A pump includes a third cylinder and a first plunger located in the third cylinder, secured to the plate for pivotal movement about the first axis and rotary oscillation about the second axis. The plunger displaces fluid from the third cylinder as the plunger reciprocates.

Energy from one engine piston is used to compress the fuel-air charge in the other engine cylinder and to refill a pump cylinder. The speed of the pump plungers can be controlled and maintained below a critical speed. No high speed-high flow control valves are needed to control the magnitude of fluid power delivered by the pump to the system. The magnitude of power loss is low compared to alternatives, and the design is compact.

The pump delivers fluid to the powertrain system against pressure in the supply rail. When that pressure varies, the flow rate produced by the pump can be adjusted by varying the pump stroke using the device of this invention. The device allows for constant engine power stroke while providing complete control of the pump plunger stroke in an efficient package space.

Various objects and advantages of this invention will become apparent to those skilled in the art from the following detailed description of the preferred embodiment, when read in light of the accompanying drawings.

BRIEF DESCRIPTION OF THE DRAWINGS

FIG. 2 is an isometric cross sectional view showing an engine-pump assembly and the control device for adjusting the stroke of the pump;

FIG. 3 is a cross sectional view similar to that of FIG. 2 showing the device in operation and producing a minimum stroke;

FIG. 4 is a cross sectional view showing the device operating and producing a maximum pump plunger stroke; and FIG. 5 is a cross sectional view showing the device arranged to produce intermediate amplitude of pump plunger stroke.

DETAILED DESCRIPTION OF THE PREFERRED EMBODIMENT

Figure 1:
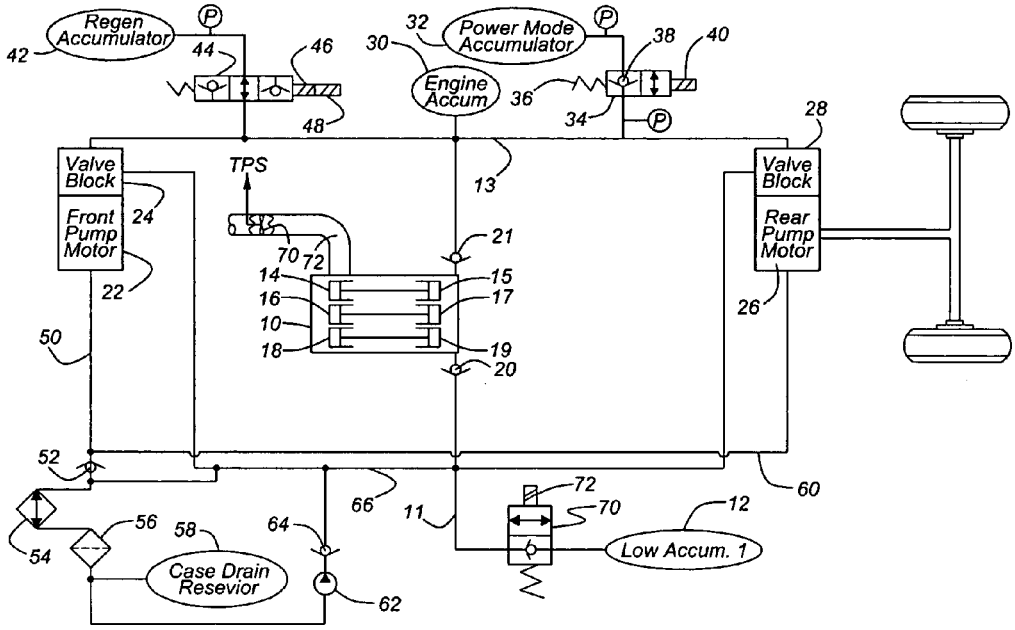
FIG. 1 is a schematic diagram of a hybrid hydraulic system, to which the control of the present invention can be applied.

Referring first to the system illustrated in FIG. 1, a engine-pump 10 supplies hydraulic fluid from a low pressure line 11, which is hydraulically connected to a low-pressure accumulator 12, to a high pressure line or rail 13. The engine 10 is divided into multiple banks of cylinders 14, 16 and 18, each cylinder driveably connected to a hydraulic pump 15, 17 and 19. Check valves 20 are located in the fluid path between low-pressure line 11 and the inlet of each pump 15, 17 and 19. Check valves 21 are located in the fluid path between high pressure line 13 and the outlet of each pump. High pressure rail 13 is connected to a front pump/motor 22 and a rear pump/motor 26, which are supplied with pressure at substantially the same magnitude. The flow produced by engine 10 is directly proportional to the number of operative cylinders and the engine speed. Therefore, power output by the engine is closely related to line pressure, the pressure in rail 13.

A front hydraulic pump motor 22 is supplied with relatively high pressure fluid through a valve body 24, connected to high pressure line 13. Pump/motor 22 is driveably connected to the front wheels of a motor vehicle. Similarly, the rear hydraulic pump/motor 26 is supplied with high pressure hydraulic fluid through a valve body 28, connected to high pressure rail 13. The rear wheels of the motor vehicle are driven in rotation by pump/motor 26. The front and rear pump/motors 22, 26 are variable displacement hydraulic pumps, each pump having a maximum displacement or volumetric flow rate.

When an increase of power must be delivered to the front wheels and rear wheels through the pump/motors 22, 26 while the pumps are operating at maximum displacement, the pressure supply to the pump motors must be increased in order to increase the output power from the pump/motors. During normal operation the pump/motors 22, 26 generate torque by fluid flow from high pressure rail 13 to low pressure line 11. When the wheel brakes are braking the vehicle, the direction of torque and direction of fluid flow are reversed. Disregarding losses, torque is proportional to the product of displacement and pressure difference. Flow rate is proportional to the product of speed and displacement.

The hydraulic fluid outlet side of the engine 10, through which rail 13 is supplied, is connected to an engine accumulator 30, which buffers or attenuates hydraulic pressure pulses produced by variations in engine speed and its inertia. A high pressure or power mode accumulator 32 communicates with rail 13 through a valve 34. A spring 36 biases the valve 34 to the position shown in FIG. 1, where check valve 38 opens and closes the hydraulic connection between accumulator 32 and rail 13 depending on that pressure differential across valve 34. When actuated, solenoid 40 overcomes the effect of spring 36 and moves the valve to a second state where a connection between accumulator 32 and rail 13 is open through the valve.

A brake regeneration accumulator 42 stores energy recovered during the process of braking the drive wheels of the motor vehicle and stores that energy in the form of relatively high pressure hydraulic fluid. Accumulator 42 is connected to and disconnected from line pressure in rail 13 through a valve 44 in accordance with the state of two control solenoids 46, 48.

The outlet side of the front pump/motor 22 is connected through line 50 and check valve 52 to a heat exchanger 54, filter 56 and a case drain reservoir 58. Similarly, the outlet side of the rear hydraulic pump/motor 26 is connected through line 60 to the case drain reservoir 58. A recovery pump 62 draws hydraulic fluid from the reservoir 58 and supplies fluid to the system through a check valve 64 and line 66. Line 66 mutually connects the valve blocks 24, 28, and accumulator 12 is connected to line 66, through which the inlet side of the hydraulic pumps 15, 17, 19 are supplied.

Referring to FIG. 2, engine cylinder 14 contains a piston 80, and engine cylinder 16 contains a piston 82, the pistons reciprocating within the respective cylinders mutually out of phase. Preferably, the pistons operate counter-cyclically such that when piston 80 is at its top dead center TDC position in cylinder 14, piston 82 is at its bottom dead center BDC position in cylinder 16. Similarly when piston 80 is at its BDC position in cylinder 14, piston 82 is at its TDC position in cylinder 16. Pistons 80 and 82 reciprocate parallel to a vertical axis 84.

A swash plate 86 is supported on a block 90 for pivotal movement about an axis 88, which is substantially perpendicular to axis 88. Piston 80 includes a stub shaft 92, to which a connecting rod 94 is secured. Piston 82 includes a stub shaft 96, to which a connecting rod 98 is secured. Each connecting rod is secured at its opposite end 100, 102 to swashplate 86. As the pistons reciprocate out of phase, the swash plate continually pivots about axis 88.

Located below the swashplate 86, a rotary plate 104 is secured to, and supports the swashplate for rotary movement on a bearing 106. Plate 104 oscillates about axis 84 in response to a force applied to plate 104 by an actuator 108 tending to rotatably oscillate plate 104 about axis 84 through an angle of about 90 degrees. Preferably, actuator 108 is either a stepper motor or a solenoid actuated by an electrical signal produced by an electronic controller.

A hydraulic plunger 110 reciprocates within hydraulic cylinder 15 formed in a turret block 118 located in block 90. A hydraulic plunger 112 reciprocates within hydraulic cylinder 17, which is also formed in the turret block 118. Plunger 110 is connected by a connecting rod 114 to oscillating plate 104. Plunger 112 is connected by connecting rod 116 to oscillating plate 104. Preferably, each end of the connecting rods is formed with a universal joint for connection to plate 104 and to the plungers 110, 112.

Turret block 114 is supported on block 90 for rotary oscillation about axis 84 as plate 104 is moved by the actuator 108. The low pressure rail 66 is connected through check valve 20 to each of the hydraulic cylinders 15, 17 at the pump inlet. The high pressure rail 13 is connected through check valve 21 to each of the hydraulic cylinders 15, 17 at the pump outlet.

In FIG. 3, rotary plate 104 is located angularly about axis 84 such that there is little displacement of hydraulic plungers 114, 116. When the device is disposed as shown in FIG. 3, displacement of the hydraulic plungers 114, 116 is a minimum, and the engine is operating at a no load condition.

FIG. 4 is a view showing rotary plate 104 rotated about 90° clockwise about axis 84 with respect to its position in FIG. 3. Engine pistons 80, 82, reciprocating out of phase, pivot swashplate 86 about axis 88, and drive hydraulic plungers 110, 112 to reciprocate in phase with the swashplate. With the device disposed as in FIG. 4, pump displacement is a maximum, and the engine is operating under the full load.

FIG. 5 shows the rotary oscillating plate 104 disposed angularly approximately midway between the positions of FIGS. 3 and 4. With the device arranged as shown in FIG. 5, the stroke or displacement of the hydraulic plungers 114, 116 is an intermediate displacement between the displacements illustrated in FIGS. 3 and 4.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for adjusting the displacement of an engine-pump assembly, comprising:

a swashplate supported for pivotal movement about a first axis;

an engine having first and second cylinders, a first piston located in the first cylinder and secured to the swashplate at a first side of the first axis, and a second piston located in the second cylinder and secured to the swashplate at a second side of the first axis opposite the first side;

a plate secured to the swashplate for pivotal movement about the first axis and supported for rotary oscillation relative to the swashplate about a second axis; and a pump including a third cylinder, and a first plunger located in the third cylinder, secured to the plate for pivotal movement about the first axis and rotary oscillation about the second axis.

2. The apparatus of claim 1, wherein the pump further comprises:

a fourth cylinder; and a second plunger located in the fourth cylinder, secured to the plate for pivotal movement about the first axis and rotary oscillation about the second axis.

3. The apparatus of claim 1, wherein the pump further comprises:

a fourth cylinder;

a second plunger located in the fourth cylinder, secured to the plate for pivotal movement about the first axis and rotary oscillation about the second axis; and an actuator secured to the plate for angularly displacing the plate about the second axis.

4. The apparatus of claim 1, wherein the second axis is substantially perpendicular to the first axis.

5. The apparatus of claim 1, wherein the first piston reciprocates out of phase in relation to the second piston, a phase of the first piston being counter cyclic to a phase of the second piston.

6. The apparatus of claim 1, wherein the pump further comprises:

a first connecting rod secured to the swashplate at a first side of the first axis, and secured to the first piston; and a second connecting rod secured to the swashplate at a second side of the first axis opposite the first side, and secured to the second piston;

a third connecting rod secured to the plate and to the first plunger; and a fourth connecting rod secured to the plate and to the second plunger.

7. The apparatus of claim 1, further comprising:

an actuator secured to the plate for angularly displacing the plate about the second axis.

8. A system for adjusting the displacement of a fluid pump that supplies fluid to a vehicle powertrain, comprising:

a source of fluid;

a swashplate supported for pivotal movement about a first axis;

an engine first and second cylinders, a first piston located in the first cylinder and secured to the swashplate at a first side of the first axis, and a second piston located in the second cylinder and secured to the swashplate at a second side of the first axis opposite the first side;

a plate secured to the swashplate for pivotal movement about the first axis and supported for rotary oscillation relative to the swashplate about a second axis; and a pump including a turret block supported for rotary oscillation about the second axis, a third cylinder and a fourth cylinder formed in the turret block and communicating with the fluid source, a first plunger located in the third cylinder and a second plunger located in the fourth cylinder, the first and second plungers being secured to the plate for pivotal movement about the first axis and rotary oscillation about the second axis, displacing fluid from the third and fourth cylinders to a pump outlet as the plungers reciprocate.

9. The system of claim 8, further comprising:

wheels for supporting the vehicle; and fluid motors communicating with the pump outlet, for converting fluid power to rotary power and rotatably driving the wheels.

10. The system of claim 8, wherein the second axis is substantially perpendicular to the first axis.

11. The system of claim 8, wherein the first piston reciprocates out of phase in relation to the second piston, a phase of the first piston being counter cyclic to a phase of the second piston.

12. The system of claim 8, wherein the pump further comprises:

a first connecting rod secured to the swashplate at a first side of the first axis, and secured to the first piston; and a second connecting rod secured to the swashplate at a second side of the first axis opposite the first side, and secured to the second piston;

a third connecting rod secured to the plate and to the first plunger; and a fourth connecting rod secured to the plate and to the second plunger.

13. The system of claim 8, further comprising:

an actuator secured to the plate for angularly displacing the plate about the second axis.

14. A device for adjusting the displacement of a fluid pump, comprising:

a swashplate supported for pivotal movement about a first axis;

a plate secured to the swashplate for pivotal movement about the first axis and supported for rotary oscillation relative to the swashplate about a second axis; and a pump including a first pump cylinder, and a first plunger located in the first pump cylinder, secured to the plate for pivotal movement about the first axis and rotary oscillation about the second axis.

15. The device of claim 14, further comprising:

an engine having first and second cylinders, a first piston located in the first cylinder and secured to the swashplate at a first side of the first axis, a second piston located in the second cylinder and secured to the swashplate at a second side of the first axis opposite the first side.

16. The apparatus of claim 14, wherein the pump further comprises:

a second pump cylinder; and a second plunger located in the second pump cylinder, secured to the plate for pivotal movement about the first axis and rotary oscillation about the second axis.

17. The apparatus of claim 14, wherein the pump further comprises:

a second pump cylinder; and a second plunger located in the second pump cylinder, secured to the plate for pivotal movement about the first axis and rotary oscillation about the second axis;

an actuator secured to the plate for angularly displacing the plate about the second axis.

18. The apparatus of claim 14, wherein the second axis is substantially perpendicular to the first axis.

19. The apparatus of claim 14, wherein the first piston reciprocates out of phase in relation to the second piston, a phase of the first piston being counter cyclic to a phase of the second piston.

20. The apparatus of claim 14, wherein the pump further comprises:

a first connecting rod secured to the swashplate at a first side of the first axis, and secured to the first piston; and a second connecting rod secured to the swashplate at a second side of the first axis opposite the first side, and secured to the second piston;

a third connecting rod secured to the plate and to the first plunger; and a fourth connecting rod secured to the plate and to the second plunger.

21. The apparatus of claim 14, further comprising:

an actuator secured to the plate for angularly displacing the plate about the second axis.

* * * * *